US006398019B1

(12) United States Patent
Cheng

(10) Patent No.: US 6,398,019 B1
(45) Date of Patent: Jun. 4, 2002

(54) CUP WITH INDICATING DEVICE FOR CELLULAR PHONE CALL

(76) Inventor: Chen-an Cheng, No. 33, Lane 340, Section 1, Hai Tian Road, Tainan (TW)

( * ) Notice: Subject to any disclaimer, the term of this patent is extended or adjusted under 35 U.S.C. 154(b) by 0 days.

(21) Appl. No.: 09/769,475

(22) Filed: Jan. 26, 2001

(51) Int. Cl.[7] ..... B65D 77/00
(52) U.S. Cl. ..... 206/217; 446/77; 446/484
(58) Field of Search ..... 206/217; 446/74, 446/77, 81, 267, 484; 215/6; 340/692, 693.5; 84/95.2

(56) References Cited

U.S. PATENT DOCUMENTS 5,536,196 A * 7/1996 Sternberg ..... 206/217
5,904,268 A * 5/1999 Daly ..... 206/457
5,996,781 A * 12/1999 Glaser et al. ..... 206/217
6,065,609 A * 5/2000 Lake ..... 206/0.5
6,105,814 A * 8/2000 Chen ..... 220/625
6,140,932 A * 10/2000 Frank et al. ..... 206/217

* cited by examiner

*Primary Examiner*—David T. Fidei
(74) *Attorney, Agent, or Firm*—Rosenberg, Klein & Lee

(57) ABSTRACT

A cup with an indicating device for a cellular phone call is composed by a main body, an indicating device and a bottom cover. The main body is provided with a hollow in the bottom, and the indicating device is placed in the hollow with the circumference of the indicating device against the lower flange of the hollow. The bottom cover is provided with a flanged annulus to be inserted in the hollow and against the upper flange of the hollow so as to secure and cover the indicating device in the hollow.

1 Claim, 2 Drawing Sheets

CUP WITH INDICATING DEVICE FOR CELLULAR PHONE CALL

BACKGROUND OF THE INVENTION

1. Field of the Invention

The present invention relates to a cup, more particularly to a cup which is provided with an indicating device in the bottom base for showing a cellular phone call.

2. Description of the Related Art

Owing to the improvement of modern science and technology, cellular phones are very popular in our daily life. Almost every one owns a cellular phone. A cellular phone is provided with the function of telling its user that someone calls him/her by ringing or vibration. It is very efficient and convenient for a user.

However, it will still cause trouble in the following situations:

1. While in a common restaurant or a public house, a cellular phone call will not easily be recognized, and a user can not make sure whether it is his/her cellular phone call or not because of too much noise.
2. While in an office or a meeting room, it is very noisy and always causes interruption when a cellular phone ringing. Even if the vibration function of a cellular phone being used, it will still cause trouble for a user.

SUMMARY OF THE INVENTION

Therefore, the present invention is to provide a cup which is provided with an indicating device for a cellular phone call that substantially promote the practical use of a related conventional cup.

An object of the present invention is to provide a cup which is provided with an indicating device in the bottom base that can quickly bring to the user's attention that there is a cellular phone call when the indicating device sensors a cellular phone call and glitters in a noisy situation or a meeting.

Another object of the present invention is to provide a cup with an indicating device for a cellular phone call which can still receive the message of a cellular phone call even if a cellular phone being placed in a drawer.

Yet another object of the present invention is to provide a transparent crystal or acrylic cup with an indicating device for a cellular phone call which can become very glittery and colorful when the indicating device functions so as to improve the atmosphere in a meeting.

Accordingly, a cup with an indicating device for a cellular phone call in the present invention is composed by a main body, an indicating device and a bottom cover. The main body is provided with a hollow in the bottom, and the indicating device is placed in the hollow with the circumference of the indicating device against the lower flange of the hollow. The bottom cover is provided with a flanged annulus to be inserted in the hollow and against the upper flange of the hollow so as to secure and cover the indicating device in the hollow.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
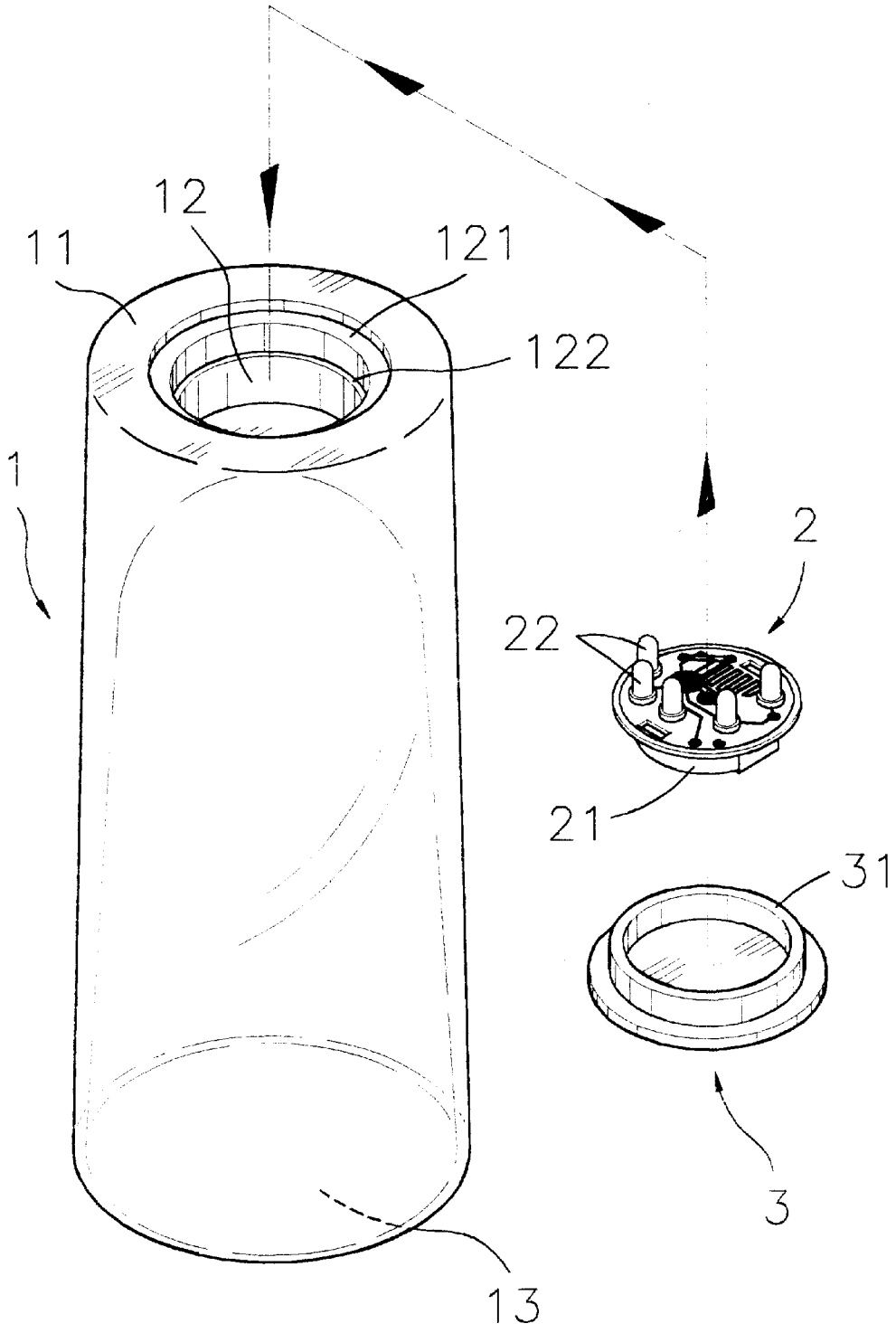
FIG. 1 is a perspective exploded view of an embodiment of the cup with an indicating device for a cellular phone call in accordance with the present invention.

Referring to FIG. 1, a preferred embodiment of a cup with an indicating device for a cellular phone call in the present invention is composed by a main body 1, an indicating device 2 and 1 bottom cover 3.

The main body 1 is provided with a hollow 12 in the lower section of the bottom base 11 of the main body 1. On the inner wall of the hollow 12 are provided with an upper flange 121 and a lower flange 122. There is a predertermined distance between the top of the hollow 12 and the bottom of the interior 13 of the main body 1, as shown in FIG. 2.

The indicating device 2 is assembled by a circular electric circuit plate, a battery 21 and a plurality of bulbs 22.

The bottom cover 3 is a circular tray provided with a flanged annulus 31 on inner surface.

Figure 2:
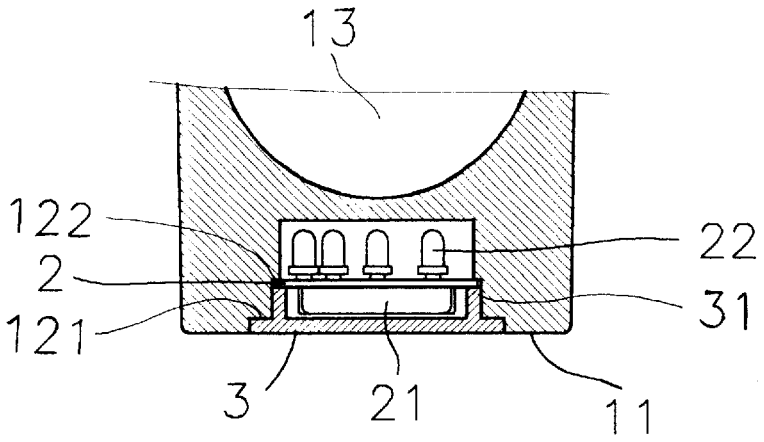
FIG. 2 is a sectional view of the cup with an indicating device for a cellular phone call in assembled configuration in accordance with the present invention; and, FIG. 3 is a perspective schematic view of the indicating device in the bottom of the cup functioning when it sensors a cellular phone call in accordance with the present invention.

While being assembled, referring to FIGS. 1 and 2, the main body 1 is placed with the opening of the interior 13 downward, and the indicating device 2 is placed in the hollow 12 of the main body 1 with the circumference of the circular electric circuit plate of the indicating device 2 against the lower flange 122 of the hollow 12. The bottom cover is inserted in the hollow 12 with the flanged annulus 31 against the upper flange 121 of the hollow 12 so as to secure and cover the indicating device 2 in the hollow 12, as shown in FIG. 2.

Figure 3:
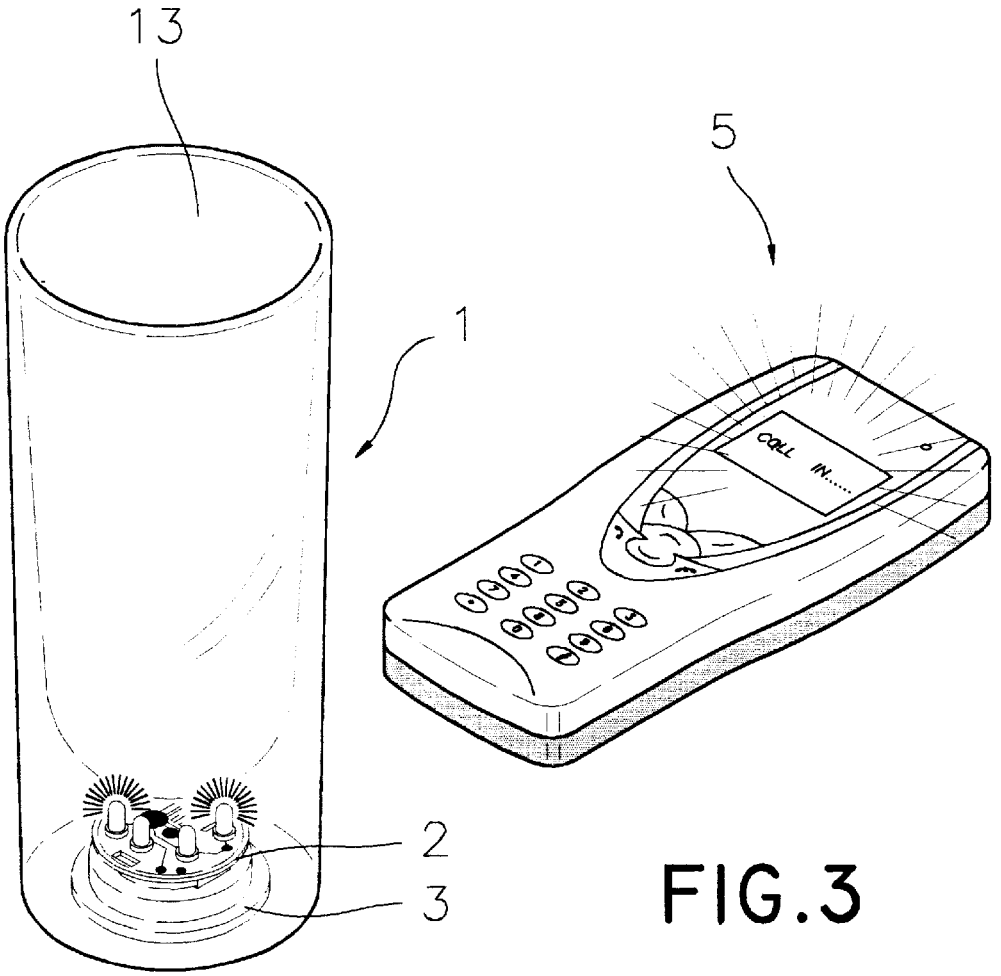

While being operated, referring to FIG. 3, a cellular phone 5 is placed within 60 cm near the main body 1, and the vibration function of the cellular phone 5 is used. When the phone number of the cellular phone 5 being dialed, the indicating device 2 in the hollow 12 of the main body 1 will immediately sensor and receive the message of a cellular phone call, and the electric circuit will conduct electricity to the bulbs 22 to make the bulbs 22 glitter so as to clearly bring to the user's attention for a cellular phone call.

While the preferred embodiments of the invention have been described above, it will be recognized and understood that various modifications may be made therein and the appended claims are intended to cover all such modifications which may fall within the spirit and scope of the invention.

What is claimed is:

1. A cup with indicating device for a cellular phone call comprising:

a main body being provided with an interior in the center and a hollow in the lower section of the bottom base of said main body, on the inner wall of said hollow being provided with an upper flange and a lower flange, a predetermined distance being provided between the top of said hollow and the bottom of said interior of said main body;

an indicating device being assembled by a circular electric circuit plate, a battery and a plurality of bulbs; and, a bottom cover being shaped as a circular tray provided with a flanged annulus on inner surface, while being assembled, said main body being placed with the opening of said interior downward, and said indicating device being placed in said hollow of said main body with the circumference of said circular electric circuit plate of said indicating device against said lower flange of said hollow, said bottom cover being inserted in said hollow with said flanged annulus against said upper flange of said hollow so as to secure and cover said indicating device in said hollow.

* * * * *